US010399824B2

(12) United States Patent
Le et al.

(10) Patent No.: US 10,399,824 B2
(45) Date of Patent: Sep. 3, 2019

(54) PASSENGER CONVEYOR SYSTEM AND STARTING/STOPPING CONTROL METHOD THEREOF

(71) Applicant: Otis Elevator Company, Farmington, CT (US)

(72) Inventors: JiYao Le, Shanghai (CN); LongWen Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/867,349

(22) Filed: Jan. 10, 2018

(65) Prior Publication Data

US 2018/0194597 A1 Jul. 12, 2018

(30) Foreign Application Priority Data

Jan. 11, 2017 (CN) ..... 2017 1 0017522

(51) Int. Cl.

| | |
|---|---|
| ***B66B 21/02*** | (2006.01) |
| ***B66B 21/00*** | (2006.01) |
| ***B66B 29/00*** | (2006.01) |
| ***B66B 25/00*** | (2006.01) |
| ***B66B 21/10*** | (2006.01) |

(52) U.S. Cl.

CPC ..... *B66B 25/003* (2013.01); *B66B 21/02* (2013.01); *B66B 21/10* (2013.01); *B66B 25/00* (2013.01); *B66B 29/00* (2013.01)

(58) Field of Classification Search

None

See application file for complete search history.

(56) References Cited

U.S. PATENT DOCUMENTS

| | | | | |
|---|---|---|---|---|
| 5,165,513 | A | 11/1992 | Nakatani | |
| 5,178,254 | A | 1/1993 | Saito et al. | |
| 5,601,178 | A * | 2/1997 | Zaharia | B66B 25/00 198/323 |

(Continued)

FOREIGN PATENT DOCUMENTS

| | | | |
|---|---|---|---|
| CN | 101314450 | A | 12/2008 |
| CN | 201415909 | Y | 3/2010 |

(Continued)

OTHER PUBLICATIONS

European Search Report for application EP 18151299.7, dated Jun. 6, 2018, 7 pages.

*Primary Examiner* — Kavel Singh

(74) *Attorney, Agent, or Firm* — Cantor Colburn LLP

(57) ABSTRACT

A passenger transportation system and a startup and shutdown control method thereof, wherein the passenger transportation system comprises: a plurality of series-connected passenger transportation devices; an electrical control system comprising a plurality of startup and shutdown circuits which are respectively used for controlling startup and shutdown of each of the passenger transportation devices; and an electrical interlocking assembly coupled between each of the startup and shutdown circuits, wherein the electrical interlocking assembly controls a startup and shutdown sequence of a low-position passenger transportation device and a high-position passenger transportation device by controlling closing and opening of each of the startup and shutdown circuits.

20 Claims, 6 Drawing Sheets

(56) References Cited

U.S. PATENT DOCUMENTS

| | | | | |
|---|---|---|---|---|
| 6,860,384 | B2 * | 3/2005 | Baumeister | B65G 23/24 198/832.1 |
| 7,407,048 | B2 * | 8/2008 | Boom | B66B 25/00 198/323 |
| 2014/0069771 | A1 | 3/2014 | Strieter et al. | |
| 2015/0307326 | A1 * | 10/2015 | Lustenberger | B66B 13/22 187/393 |

FOREIGN PATENT DOCUMENTS

| | | | | |
|---|---|---|---|---|
| CN | 203064983 | U | * | 7/2013 |
| CN | 204474112 | U | | 7/2015 |
| DE | 2356497 | A1 | | 5/1975 |
| JP | H0331192 | A | | 2/1991 |
| JP | H03288790 | A | | 12/1991 |
| JP | H05338977 | A | | 12/1993 |
| JP | H0859162 | A | | 3/1996 |
| JP | H0873164 | A | | 3/1996 |
| JP | 2000109282 | A | | 4/2000 |
| JP | 2001080861 | A | | 3/2001 |
| JP | 3192090 | B2 | | 7/2001 |
| JP | 2001240351 | A | | 9/2001 |
| JP | 2007008657 | A | | 1/2007 |
| JP | 2014152036 | A | | 8/2014 |

* cited by examiner

Start sequence

| Running direction | Control action | Control result |
|---|---|---|
| Elevator moves upwards | Start low-position elevator to move upwards | Normally open auxiliary contactor K1.2 is opened and upward movement executed by low-position elevator fails |
| Elevator moves upwards | Start high-position elevator to move upwards | Normally closed main contactor K2.2 is closed and upward movement executed by high-position elevator succeeds |
| Elevator moves downwards | Start low-position elevator to move downward | Normally closed main contactor K1.1 is closed and downward movement executed by low-position elevator succeeds |
| Elevator moves downwards | Start high-position elevator to move downwards | Normally open auxiliary contactor K2.1 is opened and downward movement executed by high-position elevator fails |

FIG. 3

Stop sequence

| Running direction | Control action | Control result |
|---|---|---|
| Elevator moves upwards | Stop low-position elevator | High-position elevator keeps on moving upwards |
| Elevator moves upwards | Stop high-position elevator | Normally open auxiliary contactor K1.2 is opened and low-position elevator is stopped |
| Elevator moves downwards | Stop low-position elevator | Normally open auxiliary contactor K2.1 is opened and high-position elevator is stopped |
| Elevator moves downwards | Stop high-position elevator | Low-position elevator keeps on moving downwards |

FIG. 4

PASSENGER CONVEYOR SYSTEM AND STARTING/STOPPING CONTROL METHOD THEREOF

TECHNICAL FIELD

The present invention relates to the field of passenger transportation devices, in particular to a passenger transportation system and a startup and shutdown control method thereof.

BACKGROUND ART

At present, as one type of tools for improving walking of passengers between floors or for shortening a walking distance of passengers, passenger transportation devices are very common in daily life. As one example, escalators usually used between floors of commercial buildings and moving walks usually used in large airports are especially common. Furthermore, in consideration of device arrangement space, walking distance and the like, a passenger transportation system having a plurality of passenger transportation devices used in series may be set up as well.

In regard to such system, since the application scope and use population thereof are very wide, various problems of potential safety hazards may inevitably and easily happen during use. As one situation, when a certain passenger transportation device in this passenger transportation system is stopped suddenly due to a fault, since an upstream passenger transportation device thereof is still in a control logic of normal operation, it is very possible to cause situations such as passengers on the upstream passenger transportation device and passengers stagnated on the faulted passenger transportation device are gathered, which probably causes safety incidents such as stampede or collision, and mass casualty incidents are even possibly caused under more serious situations. How to improve the safety startup and shutdown control of the plurality of passenger transportation devices in such passenger transportation system becomes a technical problem which needs to be urgently solved in this field.

SUMMARY OF THE INVENTION

The present invention aims at providing a passenger transportation system with high reliability.

The present invention further aims at providing a startup and shutdown control method for the passenger transportation system with high reliability.

In order to realize the purpose of the present invention, according to one aspect of the present invention, a passenger transportation system is provided. The passenger transportation system comprises: a plurality of series-connected passenger transportation devices; an electrical control system comprising a plurality of startup and shutdown circuits which are respectively used for controlling startup and shutdown of each of the passenger transportation devices; and an electrical interlocking assembly coupled between each of the startup and shutdown circuits, wherein the electrical interlocking assembly controls a startup and shutdown sequence of a low-position passenger transportation device and a high-position passenger transportation device by controlling closing and opening of each of the startup and shutdown circuits.

According to another aspect of the present invention, a startup and shutdown control method for the passenger transportation system is provided. The method comprises: a start step S100, in which a downstream passenger transportation device is firstly started and then an upstream passenger transportation device is started; and a stop step S200, in which the upstream passenger transportation device is firstly stopped and then the downstream passenger transportation device is stopped.

BRIEF DESCRIPTION OF THE DRAWINGS

FIG. 3 is a schematic table of control actions and control results of each of contactors in a startup and shutdown circuit when a passenger transportation system is started according to one embodiment of the present invention.

FIG. 4 is a schematic table of control actions and control results of each of contactors in a startup and shutdown circuit when a passenger transportation system is stopped according to one embodiment of the present invention.

DETAILED DESCRIPTION

Figure 1:
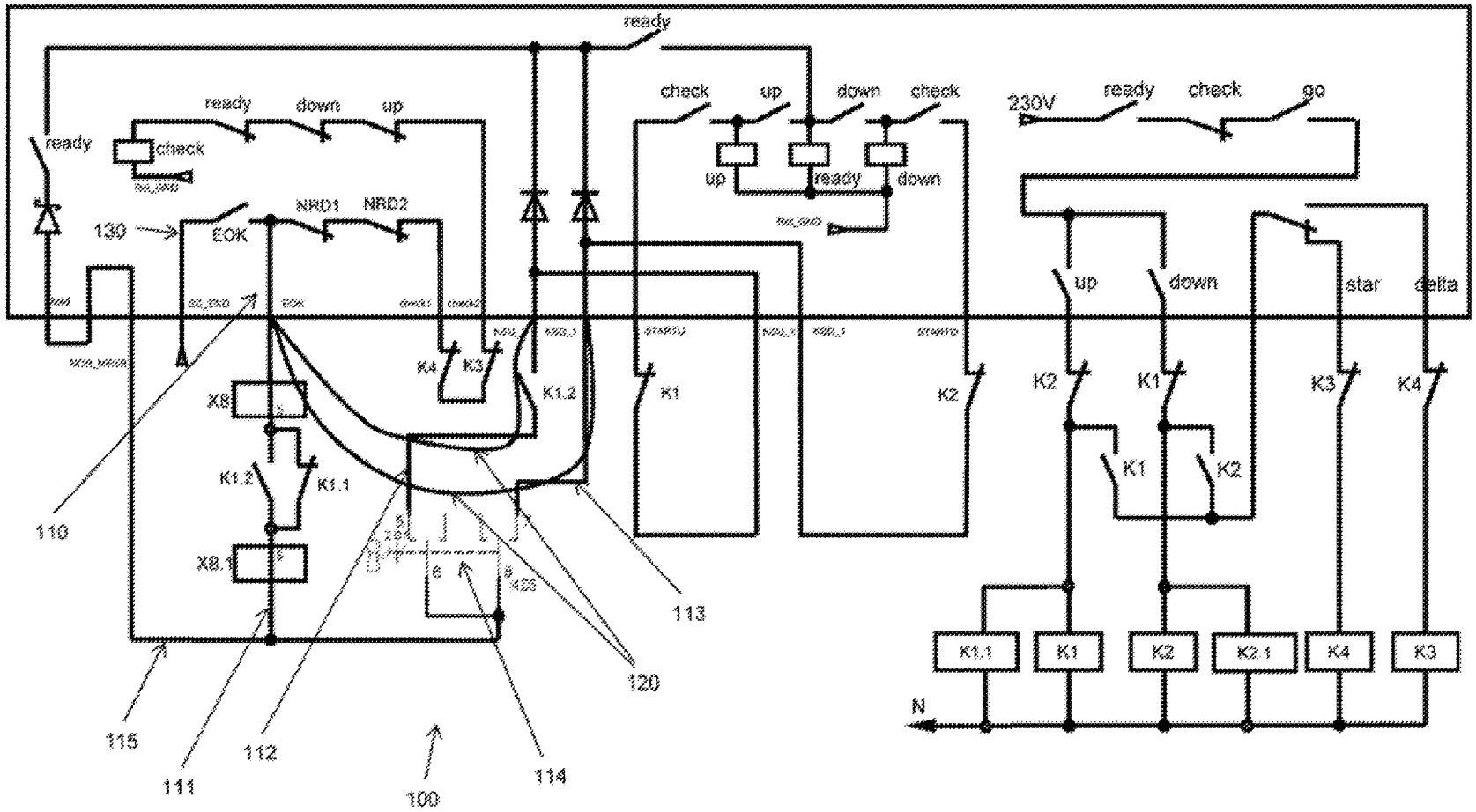
FIG. 1 is a schematic diagram of partial circuits of an electrical control system of a low-position passenger transportation device according to one embodiment of the present invention.

The present invention will be more completely described with reference to the accompanying drawings, which illustrate exemplary embodiments of the present invention. However, the present invention can be implemented according to many different modes and shall be not understood as limited to the embodiments described herein. Contrarily, these embodiments are provided so that the present disclosure is thorough and complete, and to completely convey the concept of the present invention to one skilled in the art. In the drawings, the same reference signs represent the same components or parts, and thus the description thereof is omitted. Besides, some circuit diagrams illustrated in the drawings are not complete circuit diagrams for establishing the entire electrical control system of a passenger transportation device but are just illustrated parts closely related to the concept.

In the present invention, the passenger transportation devices comprise Escalators and Moving Walks. In the embodiments illustrated below, a monitoring system and a monitoring method of the passenger transportation device provided by the embodiment of the present invention is described below in detail by taking an escalator as an example. However, it should be understood that the monitoring system and the monitoring method with respect to the escalator in the following embodiments may also be analogically applied to moving walks, and for example, adaptive improvements which are possibly required can be known by one skilled in the art under the teaching of the embodiments of the present invention.

A passenger transportation system in one embodiment of the present invention comprises: a plurality of series-connected passenger transportation devices; an electrical control system comprising a plurality of startup and shutdown circuits which are respectively used for controlling startup and shutdown of each of the passenger transportation devices; and an electrical interlocking assembly coupled between each of the startup and shutdown circuits, wherein the electrical interlocking assembly controls a startup and shutdown sequence of a low-position passenger transportation device and a high-position passenger transportation device by controlling closing and opening of each of the startup and shutdown circuits. In the passenger transportation system according to this embodiment, by realizing startup and shutdown correlation between the startup and shutdown circuits of each of the passenger transportation devices by using the electrical interlocking assembly, and thereby realizing the control of the startup and shutdown sequence of the low-position passenger transportation device and the high-position passenger transportation device, safety incidents caused by an accidental situation such as other passenger transportation devices operate normally while a certain passenger transportation is stopped suddenly or an upstream passenger transportation device operates normally while a downstream passenger transportation device is stopped suddenly are avoided, and the startup and shutdown reliability of the passenger transportation systems is greatly improved.

Several specific implementation modes will be listed below to specifically describe an arrangement and roles of electrical components in the startup and shutdown circuits.

Figure 2:
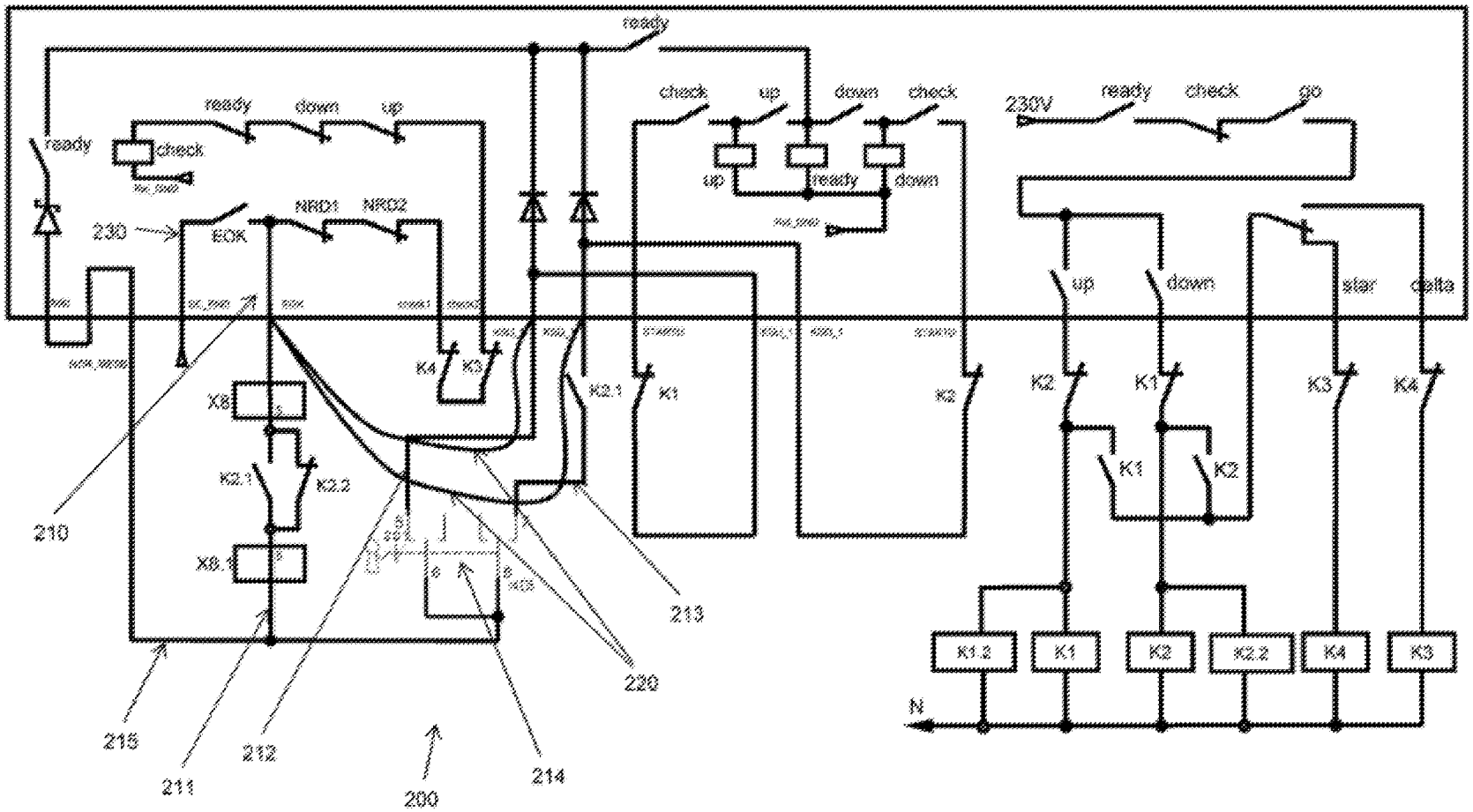
FIG. 2 is a schematic diagram of partial circuits of an electrical control system of a high-position passenger transportation device according to one embodiment of the present invention.
Figure 5:
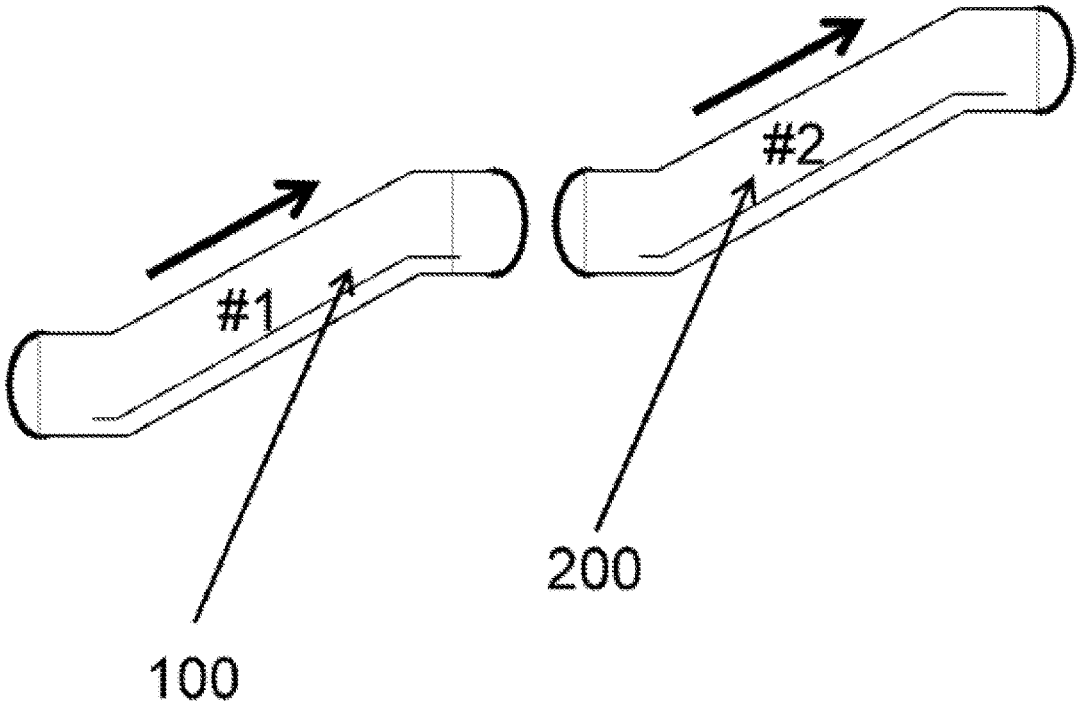
FIG. 5 is a schematic view of upward movement of a passenger transportation system according to one embodiment of the present invention.
Figure 6:
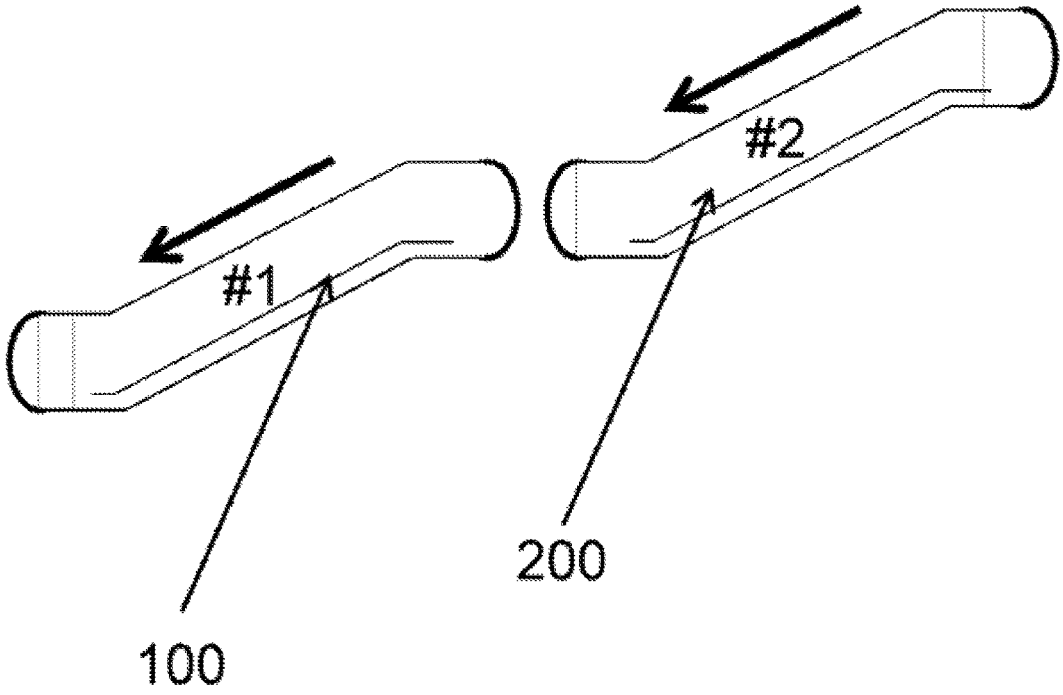
FIG. 6 is a schematic view of downward movement of a passenger transportation system according to one embodiment of the present invention.

Referring to FIG. 1 and FIG. 2, which respectively illustrate partial startup and shutdown circuits 110, 210 of a low-position passenger transportation device and a high-position passenger transportation device which belong to the same passenger transportation system, wherein the low-position passenger transportation device and the high-position passenger transportation device respectively refer to passenger transportation devices which are mounted at a higher position and a lower position in an applicable place. Specifically, each of the startup and shutdown circuits 110, 210 respectively comprises a power supply branch 111, 211 with a main contactor K1.1, K2.2, an upward movement branch 112, 212, a downward movement branch 113, 213 and a changeover switch 114, 214. Herein, in regard to the low-position passenger transportation device 100, the changeover switch 114 optionally connects the power supply branch 111 with the upward movement branch 112, or connects the power supply branch 111 with the downward movement branch 113; and in regard to the high-position passenger transportation device 200, the changeover switch 214 optionally connects the power supply branch 211 with the upward movement branch 212, or connects the power supply branch 211 with the downward movement branch 213. In other words, when the system is automatically controlled or manually controlled by external personnel, each startup and shutdown circuit 110, 210 will be selected in one of upward movement and downward movement states. In addition, turned-on and turned-off states of the main contactors K1.1, K2.2 arranged on the power supply branches 111, 211 may also control the turning on and turning off of corresponding power supply branches 111, 211.

Specifically, as one example of control of the main contactor, when the high-position passenger transportation device 200 enables the upward movement branch 212, the main contactor K2.2 of the high-position passenger transportation device 200 turns on the power supply branch 211 of the high-position passenger transportation device 200, and at this moment an upward movement action of the high-position passenger transportation device 200 can be directly realized. Besides, as another example of control of the main contactor, when the low-position passenger transportation device 100 enables the downward movement branch 113, the main contactor K1.1 of the low-position passenger transportation device 100 turns on the power supply branch 111 of the low-position passenger transportation device 100, and at this moment a downward movement action of the low-position passenger transportation device 100 can be directly realized.

Alternatively, the electrical interlocking assembly comprises a plurality of auxiliary contactors K1.2, K2.1 corresponding to the plurality of series-connected passenger transportation devices, and each auxiliary contactor K1.2, K2.1 comprises a plurality of contacts in the same turned-on or turned-off state. Herein, referring to a right side of the startup and shutdown circuits 110, 210 in FIG. 1 and FIG. 2, a first contact of the auxiliary contactor K2.1 of the low-position passenger transportation device 100 is connected into the downward movement branch 213 of the high-position passenger transportation device 200. At this moment, before the low-position passenger transportation device 100 enables the downward movement branch 113, the auxiliary contactor K2.1 of the low-position passenger transportation device 100 is controlled to open the downward movement branch 213 of the high-position passenger transportation device 200. As a result of the control, the high-position passenger transportation device 200 cannot execute the downward movement action ahead of the low-position passenger transportation device 100, avoiding the situation that the low-position passenger transportation device 100 is still stopped while the high-position passenger transportation device 200 has already moved downwards, which, otherwise, would cause passengers to gather between two passenger transportation devices such that crowding or stampede happens.

Similarly, a first contact of the auxiliary contactor K1.2 of the high-position passenger transportation device 200 is connected into the upward movement branch 112 of the low-position passenger transportation device 100. At this moment, before the high-position passenger transportation device 200 enables the upward movement branch 212, the auxiliary contactor K1.2 of the high-position passenger transportation device 200 turns off the upward movement branch 112 of the low-position passenger transportation device 100. As a result of the control, the low-position passenger transportation device 100 cannot execute the upward movement action ahead of the high-position passenger transportation device 200, avoiding the situation that the high-position passenger transportation device 200 is still stopped while the low-position passenger transportation device 100 has already moved upwards, which otherwise, would also possibly cause passengers to gather between two passenger transportation devices such that crowding or stampede happens.

As one further improvement, referring to a left side of the startup and shutdown circuits 110, 210 in FIG. 1 and FIG. 2, a second contact of the auxiliary contactor K1.2 of the high-position passenger transportation device 200 is connected into the power supply branch 111 of the low-position passenger transportation device 100. At this moment, after the high-position passenger transportation device 200 disables the upward movement branch 212 due to a fault or under control, the auxiliary contactor K1.2 of the high-position passenger transportation device 200 turns off the power supply branch 111 of the low-position passenger transportation device 100, avoiding the situation that the low-position passenger transportation device 100 still moves upwards while the high-position passenger transportation device 200, which, otherwise, would possibly cause passengers to gather between two passenger transportation devices such that crowding or stampede happens.

Similarly, a second contact of the auxiliary contactor K2.1 of the low-position passenger transportation device 100 is connected into the power supply branch 211 of the high-position passenger transportation device 200. At this moment, after the low-position passenger transportation device 100 disables the downward movement branch 113 due to a fault or under control, the auxiliary contactor K2.1 of the low-position passenger transportation device 100 turns off the power supply branch 211 of the high-position passenger transportation device 200, avoiding the situation that the high-position passenger transportation device 200 still moves downwards while the low-position passenger transportation device 100 is stopped, which, otherwise, would possibly cause passengers to gather between two passenger transportation devices such that crowding or stampede happens.

As one more specific improvement, the second contacts of the auxiliary contactors K1.2, K2.1 are respectively arranged in parallel with the main contactors K1.1, K2.2. In addition, when no power is supplied, the main contactors K1.1, K2.2 and the auxiliary contactors K1.2, K2.1 are in opposite turned-on and turned-off states. By adopting such arrangement, it guarantees that the low-position passenger transportation device 100 can be directly started during downward movement, and whether the low-position passenger transportation device 100 can be started during upward movement depends on the action of the high-position passenger transportation device 200. Similarly, by adopting such arrangement, it also guarantees that the high-position passenger transportation device 200 can be directly started during upward movement, and whether the high-position passenger transportation device 200 can be started during downward movement depends on the action of the low-position passenger transportation device 100.

Alternatively, there are various implementation modes for the opposite turned-on and turned-off states of the main contactors K1.1, K2.2 and the auxiliary contactors K1.2, K2.1. As one reference implementation mode, the main contactors K1.1, K2.2 may be a normally closed contactor and the auxiliary contactors K1.2, K2.1 may be a normally open contactor.

Besides, it should be understood that, although the description is made above by taking the contactor as an example of the electrical interlocking assembly, in fact, in order to realize an electrical interlocking function, usually an electrical component (such as a contactor), a mechanical component (such as a link rod) or a combination thereof may be adopted. Therefore, under the inspiration of the concept of the present invention, one skilled in the art may also adopt other electrical components, and make some conventional schematic modifications to the above-mentioned embodiments to realize the function of the present invention, which, however, are also included in the protective scope of the present invention.

Alternatively, as one auxiliary improvement, the electrical control system further comprises inspection circuits 120, 220 respectively connected in parallel with the startup and shutdown circuits 110, 210, and an inspection switch is provided on the inspection circuits 120, 220. In such arrangement, when the inspection switch is closed, the inspection circuits 120, 220 are capable of directly bypassing the startup and shutdown circuits 110, 210 to realize independent control of upward movement, downward movement or stop of any one of the passenger transportation devices.

Figure 7:
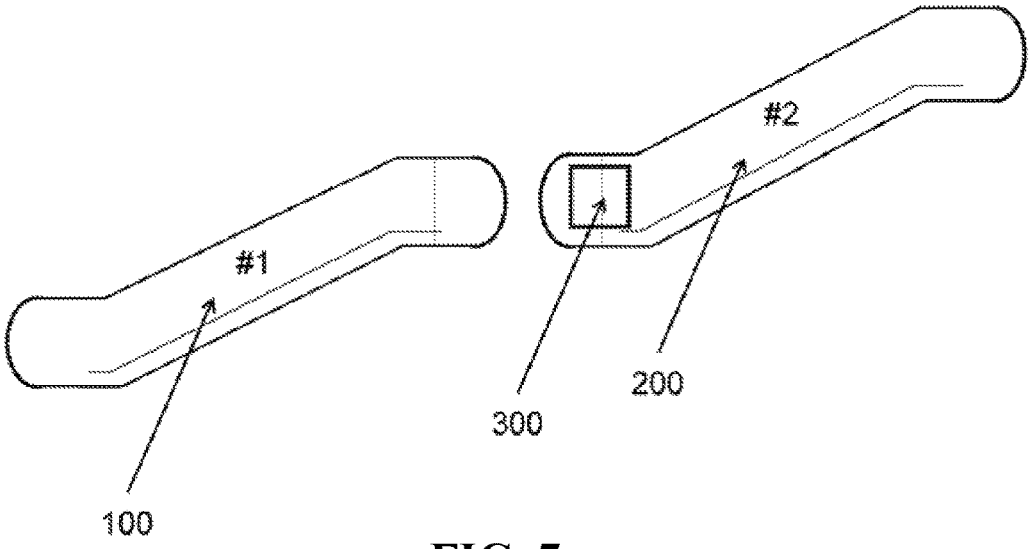
FIG. 7 is a schematic view of an arrangement position of an electrical control box according to one embodiment of the present invention.

Alternatively, referring to FIG. 7, as one reference example, when the number of the series-connected passenger transportation devices is two, an electrical control box 300 for accommodating the electrical control system is arranged in a joint area between the two passenger transportation devices, thereby a minimum modification to the original circuits and original arrangement can be realized and the cost can be greatly reduced.

Alternatively, the startup and shutdown circuits 110, 210 in this concept may be supplied with power from the existing circuit of the passenger transportation device. Herein, as one reference example, the startup and shutdown circuits 110, 210 are supplied with power through safety chain circuits 130, 230 of the corresponding passenger transportation device.

Alternatively, as one auxiliary improvement, the electrical control system further comprises self-locking branches 115, 215 which are directly connected into the upward movement circuit and the downward movement circuit from the power supply branches 111, 211.

Alternatively, the passenger transportation devices comprise escalators and/or moving walks, or other transportation tools which play the similar role of transporting passengers.

A controlled action of each contactor in the electrical control system and a control result caused thereby will be described below in combination with the above-mentioned embodiments and FIG. 1 to FIG. 6.

Referring to FIG. 1 to FIG. 3 and FIG. 5 to FIG. 6, in a process of starting the passenger transportation system, if there is a need to realize the control of the upward movement of an escalator, at this moment, when the low-position passenger transportation device 100 is directly started to move upwards, since no current is supplied to the circuit of the high-position passenger transportation device 200, the normally open auxiliary contactor K1.2 corresponding to the high-position passenger transportation device 200 is in an open state at this moment, consequently the upward movement branch 112 of the startup and shutdown circuit 110 of the low-position passenger transportation device 100 is opened and thus the upward movement executed by the low-position passenger transportation device 100 fails. As another example, also in order to realize the control of upward movement of the escalator, at this moment, when the high-position passenger transportation device 200 is directly started to move upwards, the normally closed main contactor K2.2 corresponding to the high-position passenger transportation device 200 is in a closed state, consequently the entire startup and shutdown circuit 210 of the high-position passenger transportation device 200 is turned on and thus the upward movement executed by the high-position passenger transportation device 200 succeeds.

Similarly, in a process of starting the passenger transportation system, if there is a need to realize the control of the downward movement of an escalator, at this moment, when the low-position passenger transportation device 100 is directly started to move downwards, the normally closed main contactor K1.1 corresponding to the low-position passenger transportation device 100 is in a closed state, consequently the entire startup and shutdown circuit 110 of the low-position passenger transportation device 100 is turned on and thus the downward movement executed by the low-position passenger transportation device 100 succeeds. As another example, also in order to realize the control of the downward movement of the escalator, at this moment, when the high-position passenger transportation device 200 is directly started to move downwards, since no current is supplied to the circuit of the low-position passenger transportation device 100, the normally open auxiliary contactor K2.1 corresponding to the low-position passenger transportation device 100 is in an open state, consequently the downward movement branch 213 of the startup and shutdown circuit 210 of the high-position passenger transportation device 200 is opened and thus the downward movement executed by the high-position passenger transportation device 200 fails.

Referring to FIG. 1 to FIG. 2 and FIG. 4 to FIG. 6, in a process of stopping the passenger transportation system, if there is a need to realize the control of the stop of the upward movement of an escalator, at this moment, when the low-position passenger transportation device 100 is directly stopped from moving upwards, the normally closed main contactor K2.2 corresponding to the high-position passenger transportation device 200 is in a closed state, consequently the entire startup and shutdown circuit 210 of the high-position passenger transportation device 200 is turned on and thus the high-position passenger transportation device 200 keeps on moving upwards. As another example, also in order to realize the control of the stop of the upward movement of the escalator, at this moment, when the high-position passenger transportation device 200 is directly stopped from moving upwards, since no current is supplied to the circuit of the high-position passenger transportation device 200, the normally open auxiliary contactor K1.2 corresponding to the high-position passenger transportation device 200 is in an open state, consequently the upward movement branch 112 of the startup and shutdown circuit 110 of the low-position passenger transportation device 100 is opened and thus the low-position passenger transportation device 100 is stopped from moving upwards at the same time.

Similarly, in a process of starting the passenger transportation system, if there is a need to realize the control of the stop of the downward movement of an escalator, at this moment, when the low-position passenger transportation device 100 is directly stopped from moving downwards, since the current supply to the circuit of the low-position passenger transportation device 100 is cut off, the normally open auxiliary contactor K2.1 corresponding to the low-position passenger transportation device 100 is in an open state, consequently the downward movement branch 213 of the startup and shutdown circuit 210 of the high-position passenger transportation device 200 is opened and thus the high-position passenger transportation device 200 is stopped from moving downwards at the same time. As another example, also in order to realize the control of the stop of the downward movement of the escalator, at this moment, when the high-position passenger transportation device 200 is directly stopped from moving downwards, the normally closed main contactor K1.1 corresponding to the low-position passenger transportation device 100 is in a closed state, consequently the entire startup and shutdown circuit 110 of the low-position passenger transportation device 100 is turned on and thus the low-position passenger transportation device 200 keeps on moving downwards.

It should be mentioned that, although the present invention is described above by taking the passenger transportation system comprising two passenger transportation devices as an example, one skilled in the art should understand that the concept of the present invention is also applicable to a passenger transportation system comprising more than two passenger transportation devices. In regard to such system, the low-position passenger transportation device and the high-position passenger transportation device mentioned in the foresaid embodiments are presented as relative concepts. For example, in an example of a passenger transportation system comprising three series-connected passenger transportation devices, the middle passenger transportation device and the lowest passenger transportation device relatively form a first pair of low-position passenger transportation device and high-position passenger transportation device; the middle passenger transportation device and the highest passenger transportation device relatively form a second pair of low-position passenger transportation device and high-position passenger transportation device; and the lowest passenger transportation device and the highest passenger transportation device relatively form a third pair of low-position passenger transportation device and high-position passenger transportation device. At this moment, when the electrical systems and hardware facilities of the three pairs of low-position passenger transportation devices and high-position passenger transportation devices respectively satisfy the limitations described in the foresaid embodiments, they are also applicable to the concept of the present invention, can bring the same or similar technical effects and have high startup and shutdown control reliability.

According to one aspect of the concept, in combination with the passenger transportation system described above, one embodiment of a startup and shutdown control method is further provided herein.

The startup and shutdown control method comprises: a start step S100, in which a downstream passenger transportation device is firstly started and then an upstream passenger transportation device is started; and a stop step S200, in which the upstream passenger transportation device is firstly stopped and then the downstream passenger transportation device is stopped. Therefore, the control of the startup and shutdown sequence of the downstream passenger transportation device and the upstream passenger transportation device is realized, avoiding dangerous situations such as starting of the upstream passenger transportation device ahead of the downstream passenger transportation device or stopping of the downstream passenger transportation device ahead of the upstream passenger transportation device, thus avoiding the situation of people crowding or stampede, which greatly improves the startup and shutdown reliability and safety of the passenger transportation system.

Alternatively, as one safety measure, step S100 further comprises: a start protection step S110, in which when the downstream passenger transportation device is stopped, the upstream passenger transportation device cannot be started. This safety auxiliary measure can further avoid the situation of people crowding or stampede.

Alternatively, as one auxiliary measure, the startup and shutdown control method further comprises an inspection step S300, in which the plurality of series-connected passenger transportation devices can be started and/or stopped in any sequence. In this mode, the plurality of passenger transportation devices can realize free control and operations without being restricted by mutual startup and shutdown states, which are more beneficial to the inspection and maintenance of the problem of each passenger transportation device, improving the inspection efficiency and reliability.

Alternatively, in consideration of completeness of the control method, before the system operates formally, the startup and shutdown control method further comprises: a power-on step S400, in which power is supplied to the plurality of series-connected passenger transportation devices.

Herein, the upstream passenger transportation device and the downstream passenger transportation device mentioned in the above-mentioned control method do not specifically refer to certain passenger transportation devices, but refer to one kind of passenger transportation devices with a common relative position property. For example, as one example, when the passenger transportation system moves upwards, the upstream passenger transportation device is the low-position passenger transportation device 100 and the downstream passenger transportation device is the high-position passenger transportation device 200. As another example, when the passenger transportation device moves downwards, the upstream passenger transportation device is the high-position passenger transportation device 200 and the downstream passenger transportation device is the low-position passenger transportation device 100.

The above-mentioned examples mainly describe the passenger transportation system and the startup and shutdown control method thereof provided by the present invention. Although only some implementation modes of the present invention are described, one skilled in the art should understand that the present invention may be implemented according to many other modes without departing from the essence and scope thereof. Therefore, the presented examples and implementation modes are viewed as exemplary instead of restrictive. The present invention possibly covers various modifications and replacements without departing from the spirit and scope of the present invention defined by the claims.

What is claimed is:

1. A passenger transportation system, wherein, the passenger transportation system comprises:

a plurality of series-connected passenger transportation devices, the plurality of series-connected passenger transportation devices comprising a first passenger transportation device and a second passenger transportation device configured to convey passengers in a serial manner;

an electrical control system comprising a plurality of startup and shutdown circuits which are respectively used for controlling startup and shutdown of each of the passenger transportation devices; and an electrical interlocking assembly coupled between each of the startup and shutdown circuits, wherein the electrical interlocking assembly controls a startup and shutdown sequence of the first passenger transportation device and the second passenger transportation device by controlling closing and opening of each of the startup and shutdown circuits;

wherein the electrical interlocking assembly is configured to perform at least one of (i) prior to enabling movement of the first passenger transportation device in a direction, the electrical interlocking assembly disables movement of the second passenger transportation device in the direction and (ii) after disabling movement of the first passenger transportation device in a direction, the electrical interlocking assembly disables movement of the second passenger transportation device in the direction.

2. The passenger transportation system according to claim 1, wherein, each of the startup and shutdown circuits comprises a power supply branch with a main contactor, an upward movement branch, a downward movement branch and a changeover switch, wherein the changeover switch optionally connects the power supply branch with the upward movement branch or connects the power supply branch with the downward movement branch.

3. The passenger transportation system according to claim 2, wherein, when the second passenger transportation device enables the upward movement branch, the main contactor of the second passenger transportation device turns on the power supply branch of the second passenger transportation device; and/or when the first passenger transportation device enables the downward movement branch, the main contactor of the first passenger transportation device turns on the power supply branch of the first passenger transportation device.

4. The passenger transportation system according to claim 2, wherein, the passenger transportation system further comprises a self-locking branch directly connected into an upward movement circuit and a downward movement circuit from a power supply branch.

5. The passenger transportation system according to claim 1, wherein, the electrical control system further comprises an inspection circuit connected in parallel with the startup and shutdown circuit, and an inspection switch is provided on the inspection circuit; and when the inspection switch is closed, the inspection circuit is capable of bypassing the startup and shutdown circuit.

6. The passenger transportation system according to claim 1, wherein, when the number of the series-connected passenger transportation devices is two, an electrical control box for accommodating the electrical control system is arranged in a joint area between the two passenger transportation devices.

7. The passenger transportation system according to claim 1, wherein, the startup and shutdown circuit is supplied with power through a safety chain circuit of a corresponding passenger transportation device.

8. The passenger transportation system according to claim 1, wherein, the passenger transportation devices comprise escalators and/or moving walks.

9. A passenger transportation system, wherein, the passenger transportation system comprises:

a plurality of series-connected passenger transportation devices, the plurality of series-connected passenger transportation devices comprising a first passenger transportation device and a second passenger transportation device configured to convey passengers in a serial manner;

an electrical control system comprising a plurality of startup and shutdown circuits which are respectively used for controlling startup and shutdown of each of the passenger transportation devices; and an electrical interlocking assembly coupled between each of the startup and shutdown circuits, wherein the electrical interlocking assembly controls a startup and shutdown sequence of the first passenger transportation device and the second passenger transportation device by controlling closing and opening of each of the startup and shutdown circuits;

wherein, each of the startup and shutdown circuits comprises a power supply branch with a main contactor, an upward movement branch, a downward movement branch and a changeover switch, wherein the changeover switch optionally connects the power supply branch with the upward movement branch or connects the power supply branch with the downward movement branch;

wherein, the electrical interlocking assembly comprises a plurality of auxiliary contactors corresponding to the plurality of series-connected passenger transportation devices, and each of the auxiliary contactor comprises a plurality of contacts in the same turned-on or turned-off state, wherein a first contact of the auxiliary contactor of the first passenger transportation device is connected into the downward movement branch of the second passenger transportation device; and a first contact of the auxiliary contactor of the second passenger transportation device is connected into the upward movement branch of the first passenger transportation device.

10. The passenger transportation system according to claim 9, wherein, before the second passenger transportation device enables the upward movement branch, the auxiliary contactor of the second passenger transportation device turns off the upward movement branch of the first passenger transportation device; and/or before the first passenger transportation device enables the downward movement branch, the auxiliary contactor of the first passenger transportation device turns off the downward movement branch of the second passenger transportation device.

11. The passenger transportation system according to claim 9, wherein, a second contact of the auxiliary contactor of the second passenger transportation device is connected into the power supply branch of the first passenger transportation device; and a second contact of the auxiliary contactor of the first passenger transportation device is connected into the power supply branch of the second passenger transportation device.

12. The passenger transportation system according to claim 11, wherein, after the second passenger transportation device disables the upward movement branch, the auxiliary contactor of the second passenger transportation device turns off the power supply branch of the first passenger transportation device; and/or after the first passenger transportation device disables the downward movement branch, the auxiliary contactor of the first passenger transportation device turns off the power supply branch of the second passenger transportation device.

13. The passenger transportation system according to claim 11, wherein, the second contact and the main contactor are arranged in parallel.

14. The passenger transportation system according to claim 13, wherein, when no power is supplied, the main contactor and the auxiliary contactor are in opposite turned-on and turned-off states.

15. The passenger transportation system according to claim 14, wherein, the main contactor is a normally closed contactor, and the auxiliary contactor is a normally open contactor.

16. A startup and shutdown control method of the passenger transportation system according to claim 1, wherein, the startup and shutdown control method comprises:

a start step S100, in which the first passenger transportation device is firstly started and then the second passenger transportation device is started; and a stop step S200, in which the second passenger transportation device is firstly stopped and then the first passenger transportation device is stopped.

17. The startup and shutdown control method according to claim 16, wherein, step S100 further comprises:

a start protection step S110, in which when the first passenger transportation device is stopped, the second passenger transportation device cannot be started.

18. The startup and shutdown control method according to claim 16, wherein, the startup and shutdown control method further comprises:

an inspection step S300, in which the plurality of series-connected passenger transportation devices can be started and/or stopped in any sequence.

19. The startup and shutdown control method according to claim 16, wherein, the startup and shutdown control method further comprises:

a power-on step S400, in which power is supplied to the plurality of series-connected passenger transportation devices.

20. The startup and shutdown control method according to claim 16, wherein, when the passenger transportation system moves upwards, the second passenger transportation device precedes the first passenger transportation device; and/or when the passenger transportation system moves downwards, the second passenger transportation device precedes the first passenger transportation device.

* * * * *